US010631080B2

(12) United States Patent
Lee

(10) Patent No.: US 10,631,080 B2
(45) Date of Patent: Apr. 21, 2020

(54) STRUCTURE OF MICROSPEAKER

(71) Applicant: BUJEON CO., LTD., Ansan-si (KR)

(72) Inventor: Seungcheol Lee, Ansan-si (KR)

(73) Assignee: BUJEON CO., LTD., Ansan-si (KR)

( * ) Notice: Subject to any disclaimer, the term of this patent is extended or adjusted under 35 U.S.C. 154(b) by 0 days.

(21) Appl. No.: 16/285,412

(22) Filed: Feb. 26, 2019

(65) Prior Publication Data

US 2019/0289388 A1 Sep. 19, 2019

(30) Foreign Application Priority Data

Mar. 15, 2018 (KR) ..... 10-2018-0030334

(51) Int. Cl.
*H04R 1/22* (2006.01)
*H04R 1/02* (2006.01)
*H04R 9/06* (2006.01)

(52) U.S. Cl.
CPC ..... *H04R 1/22* (2013.01); *H04R 1/02* (2013.01); *H04R 9/06* (2013.01)

(58) Field of Classification Search
CPC ... H04R 1/22; H04R 9/06; H04R 1/02; H04R 1/2826; H04R 2400/11; H04R 1/1075
See application file for complete search history.

(56) References Cited

U.S. PATENT DOCUMENTS 6,560,343 B1 * 5/2003 Kim ..... H04R 5/02 181/156
7,106,878 B2 * 9/2006 Saiki ..... H04M 1/03 381/182
8,094,853 B2 * 1/2012 Seki ..... H04R 1/2826 381/337
8,708,092 B2 * 4/2014 Ito ..... H04R 1/2842 181/150
8,837,762 B2 * 9/2014 Tada ..... H04R 9/025 381/337
9,743,163 B2 * 8/2017 Ito ..... H04R 1/00
9,883,280 B2 * 1/2018 Oosato ..... H04R 1/2826
2011/0135111 A1 * 6/2011 Suzuki ..... H04R 7/20 381/86
2012/0219171 A1 * 8/2012 Velican ..... H04R 1/22 381/353

(Continued)

FOREIGN PATENT DOCUMENTS

KR 10-2013-0067227 A 6/2013
KR 20130067227 A * 6/2013 ..... H04R 9/02
KR 10-2018-0020619 A 2/2018

*Primary Examiner* — Oyesola C Ojo
(74) *Attorney, Agent, or Firm* — Korus Patent, LLC; Seong Il Jeong

(57) ABSTRACT

Disclosed herein is the structure of a microspeaker. The structure of the microspeaker includes: a frame configured to have an internal space, a magnetic field part disposed inside the frame and configured to form an air gap along with the frame, and a diaphragm configured to vibrate vertically in response to the operation of a voice coil located inside the air gap. A duct configured to guide an air flow is formed in the circumferential direction of the frame. At least one frame hole is formed such that air enters the duct from the internal chamber of the frame. At least one duct sound outlet is formed such that air having entered the duct is discharged to the outside through the guide path of the duct.

6 Claims, 8 Drawing Sheets

(56) References Cited

U.S. PATENT DOCUMENTS

2015/0181345 A1* 6/2015 Cai ..... H04R 9/06
381/412
2016/0192065 A1* 6/2016 Oosato ..... H04R 1/2826
381/378

* cited by examiner

STRUCTURE OF MICROSPEAKER

CROSS-REFERENCE TO RELATED APPLICATION

This application claims the benefit of Korean Patent Application No. 10-2018-0030334 filed on Mar. 15, 2018, which is hereby incorporated by reference herein in its entirety.

BACKGROUND

1. Technical Field

The present invention relates generally to the structure of a microspeaker, and more specifically to the structure of a microspeaker, in which bass performance may be improved by forming a duct in a frame.

2. Description of the Related Art

In general, microspeaker are widely used to convert electric signals into sound signals in portable electronic devices, such as smartphones, portable communication terminals, notebook computers, MP3 players, etc. Such a microspeaker (an earphone) includes a frame configured to have an internal space of a predetermined size therein, a magnetic circuit system accommodated inside the internal space and configured to form a gap, a diaphragm mounted over the frame, and a voice coil attached under the diaphragm and located in the gap. In this case, the voice coil is fastened under the diaphragm. Accordingly, when an external electric signal is applied to the voice coil, the voice coil is vibrated by electromagnetic force. When the voice coil is vibrated, the diaphragm vibrates and converts the electric signal into sound waves (sounds).

FIG. 1 shows the structure of a conventional earphone. The earphone shown in FIG. 1 includes a speaker driver 116 configured to have the above-described configuration, a first housing 102 configured to include a housing 113 that is coupled to one side of the speaker driver 116, a duct 122 that is formed in the housing 113, and a reactive control part 124, and a second housing 115 coupled to the first housing 102 on the opposite side of the speaker driver 116 and configured such that a pressure release port 205 is formed therein.

In this case, the duct 122 formed in the housing 113 improves the bass performance of the speaker, and the reactive control part 124 improves sound quality through the control of mid-frequency characteristics.

Meanwhile, the above-described conventional structure in which the speaker driver and the upper and lower housings are coupled to one another requires the quantitative management of the reactive control part and the duct. However, in an actual process, a deviation may occur easily in a coupled portion. Furthermore, it is difficult to perform complete sealing, and thus the process is a process having a high degree of difficulty.

SUMMARY

An object of the present invention is to provide the structure of a microspeaker, in which production efficiency may be improved through a reduction in deviation and bass performance may be also improved by disposing a duct and a reactive element in a speaker driver and sound quality may be improved by controlling mid-frequency characteristics.

According to an aspect of the present invention, there is provided the structure of a microspeaker, including:

a frame (240) configured to have an internal space, a magnetic field part disposed inside the frame (240) and configured to form an air gap along with the frame (240), and a diaphragm (210) configured to vibrate vertically in response to the operation of a voice coil (230) located inside the air gap, wherein a duct (220) configured to guide an air flow is formed in the circumferential direction of the frame (240);

wherein at least one frame hole (241) is formed such that air enters the duct (220) from the internal chamber (270) of the frame (240), and at least one duct sound outlet is formed such that air having entered the duct (220) is discharged to the outside through the guide path of the duct (220).

According to another aspect of the present invention, there is provided the structure of a microspeaker, including:

a frame (240) configured to have an internal space, a magnetic field part disposed inside the frame (240) and configured to form an air gap along with the frame (240), and a diaphragm (210) configured to vibrate vertically in response to the operation of a voice coil (230) located inside the air gap, wherein a duct (220) configured to guide an air flow is formed in the circumferential direction of the frame (240);

wherein the duct (220) is formed in the bottom of the frame (240) in the circumferential direction of the frame (240) in a groove shape, and the bottom of the duct (220) is formed by coupling a duct plate (250), corresponding to the guide path of the duct (220), to the bottom of the frame (240).

The duct plate (250) may be made of adhesive tape, material in which a damping member is combined with adhesive tape, or material capable of maintaining a plane, such as plastic or metal.

At least one duct sound outlet (252) may be formed in the duct plate (250).

The duct sound outlet may be formed in such a manner that the other end of the duct (220) is open.

The duct (220) may include one or more ducts that are formed in one or more rows along the circumferential direction of the frame (240).

The duct (220) may have a length in the range of 2 to 200 mm.

The duct sound outlet or duct (220) may have a sectional area in the range of 0.1 to 100 $mm^2$.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

The structures of microspeaker according to the present invention will be described in detail below with reference to the accompanying drawings.

Figure 1:
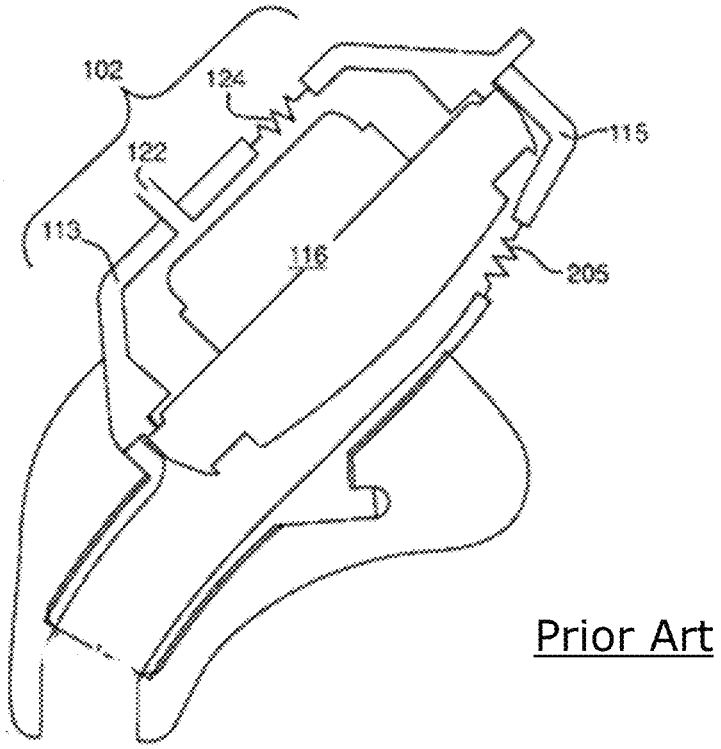
FIG. 1 is a sectional view of a conventional microspeaker.
Figure 2:
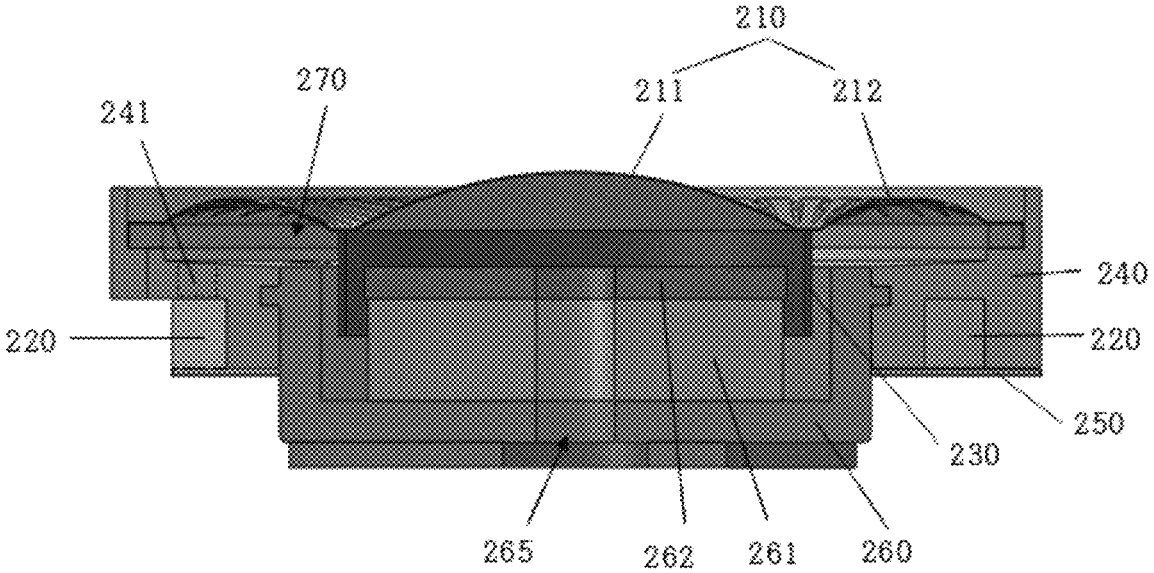
FIG. 2 is a view showing the structure of a microspeaker according to a first embodiment of the present invention.
Figure 3:
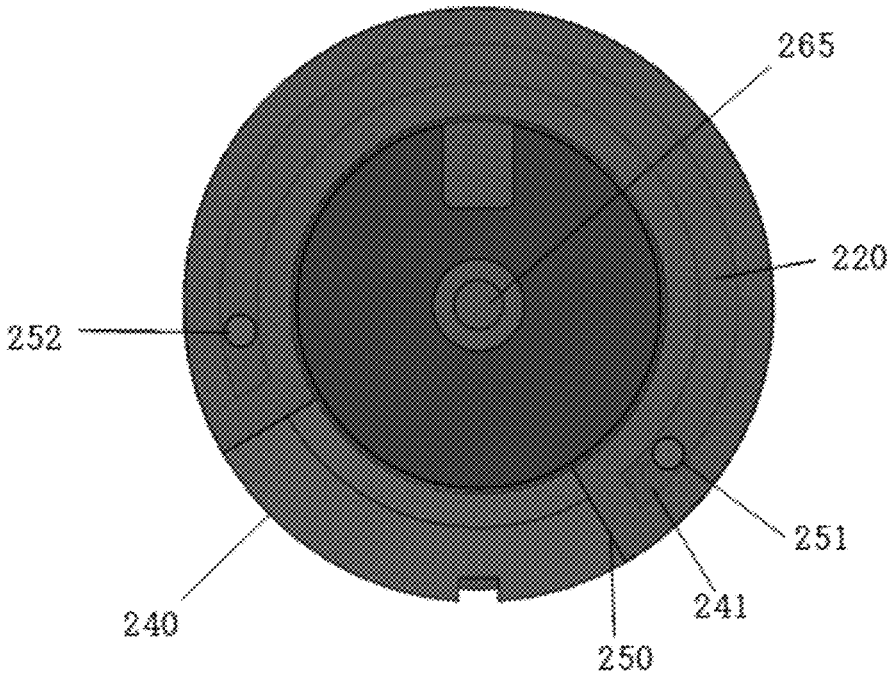
FIG. 3 is a bottom view showing the structure of the microspeaker according to the first embodiment of the present invention.
Figure 4:
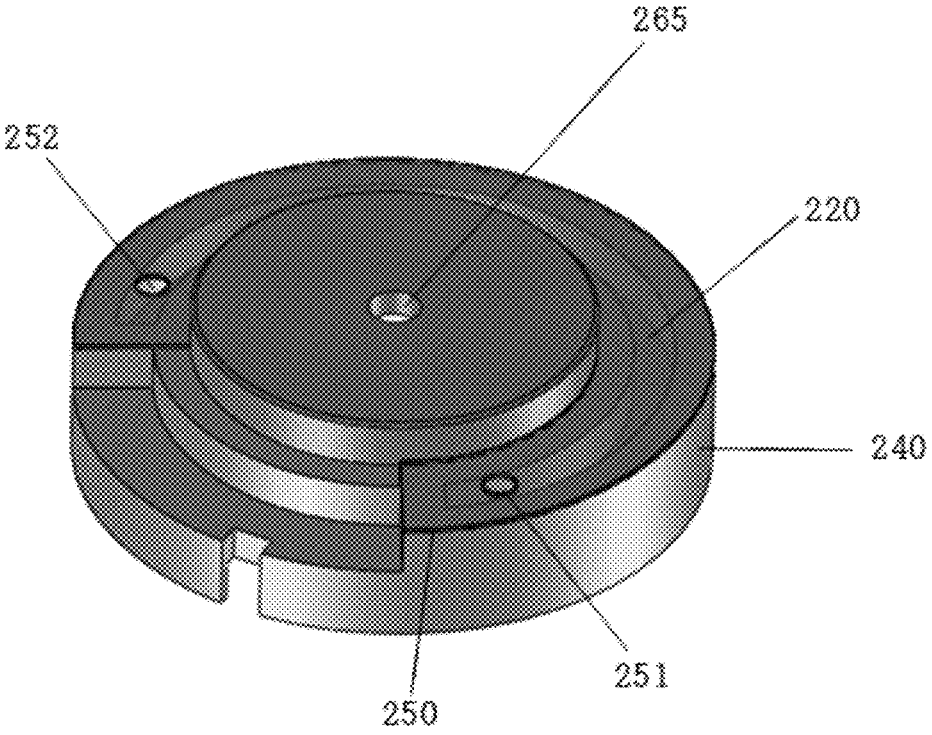
FIG. 4 is a bottom perspective view showing the structure of the microspeaker according to the first embodiment of the present invention.

FIG. 2 is a view showing the structure of a microspeaker according to a first embodiment of the present invention, FIG. 3 is a bottom view showing the structure of the microspeaker according to the first embodiment of the present invention, and FIG. 4 is a bottom perspective view showing the structure of the microspeaker according to the first embodiment of the present invention.

According to the present invention, there is provided the structure of a microspeaker, including: a frame 240 configured to have an internal space, a magnetic field part disposed inside the frame 240 and configured to form an air gap along with the frame 240, and a diaphragm 210 configured to vibrate vertically in response to the operation of a voice coil 230 located inside the air gap, wherein a duct 220 configured to guide an air flow is formed in the circumferential direction of the frame 240; wherein at least one frame hole 241 is formed such that air enters the duct 220 from the internal chamber 270 of the frame 240, and at least one duct sound outlet is formed such that air having entered the duct 220 is discharged to the outside through the duct path of the duct 220.

The frame 240 is formed in a circular frame shape, and an internal space configured to accommodate the voice coil 230 and a magnet 261 is formed inside the circular frame shape.

The diaphragm 210 is formed in an approximately circular form, is coupled to the top of the frame 240, and is configured such that a center diaphragm 211 and an edge diaphragm 212 are coupled to each other. The diaphragm 210 is configured such that the center diaphragm 211 having an upwardly convexly curved shape is formed in the center of the diaphragm 210 and the edge diaphragm 212 coupled to the edge of the center diaphragm 211 is formed around the outside of the center diaphragm 211. Furthermore, the edge diaphragm 212 is formed approximately in a doughnut shape, and includes an inner fastening portion configured to be coupled to the edge of the center diaphragm 211, an outer fastening portion configured to be fastened to the top surface of the frame 240, and a connection dome portion configured to connect the inner fastening portion and the outer fastening portion to each other. The connection dome portion is formed in an upwardly convexly curved form, as shown in the drawings.

The voice coil 230 is coupled under the bottom of the center diaphragm 211, more specifically the bottom of the inner fastening portion where the center diaphragm 211 and the edge diaphragm 212 are coupled to each other. The voice coil 230 is formed in a circular frame shape having a predetermined height. The top of the voice coil 230 is coupled to the diaphragm 210, and the voice coil 230 is located in the air gap between the frame 240 and the magnetic field part.

The magnetic field part includes a yoke plate 260 coupled to the inside of the frame 240, a magnet 261 located in the center of the yoke plate 260 and disposed beneath the voice coil 230, and an upper plate 262 installed on the top surface of the magnet 261. In the present invention, through holes are formed across the centers of the yoke plate 260, the magnet 261, and the upper plate 262, and a second reactive control part 265 is formed therein.

Furthermore, in the present invention, the duct 220 is formed in the frame 240 along the circumferential direction of the frame 240. The duct 220 formed in the frame 240 of the present invention has a length in the range of about 2 to 200 mm, and the sectional area of the path of the duct 220 ranges from about 0.1 to 100 $mm^2$. The duct 220 guides an air flow from the internal chamber 270 through the frame hole 241. The frame hole 241 is formed on one side of the top of the frame 240 in order to allow air to enter the duct 220 from the internal chamber 270.

The internal chamber 270 refers to a space formed among the diaphragm 210, the frame 240 disposed under the diaphragm 210, and the yoke plate 260. Air enters one end of the duct 220 from the internal chamber 270 through the frame hole 241, the air flow of the air is guided through the duct 220, and then the air is discharged through the duct sound outlet 252 formed at the other end of the duct 220. The sectional area of the duct sound outlet 252 ranges from about 0.1 to 100 $mm^2$.

More specifically, the duct 220 is formed in the bottom of the frame 240 along the circumferential direction of the frame 240 in a groove shape. The bottom of the duct 220 is formed by coupling a duct plate 250, corresponding to the guide path of the duct 220, to the bottom of the frame 240. In the present embodiment, the bottom of the duct 220 is formed by coupling a ring-shaped duct plate 250. In the present invention, a first reactive control part 251 including at least one hole is formed in the part of the duct plate 250 near the one end of the duct 220 where the frame hole 241 is formed, and at least one duct sound outlet 252 is formed in the part of the duct plate 250 near the other end of the duct 220. The duct plate 250 is made of adhesive tape, material in which a damping member is combined with adhesive tape, or material capable of maintaining a plane, such as plastic or metal.

The first and second reactive control parts 251 and 265 are intended to improve sound quality by controlling mid-frequency characteristics. Although the first and second reactive control parts 251 and 265 include through holes in the present embodiment, a damping member, a membrane, or a net resistor may be attached to each of the holes.

As described above, in the present invention, the duct 240 is formed in the frame 220, and thus an air flow is guided from the internal chamber 270 through the frame hole 241. Furthermore, the duct sound outlet 252 is formed at the other end of the duct 240, and thus the bass performance of the speaker is improved. Moreover, the duct and the reactive control part are formed in a speaker driver itself, and thus advantages arise in that production efficiency and manufacturing quality may be improved by reducing a deviation in a coupled portion.

Next, the structure of a microspeaker according to a second embodiment of the present invention will be described.

Figure 5:
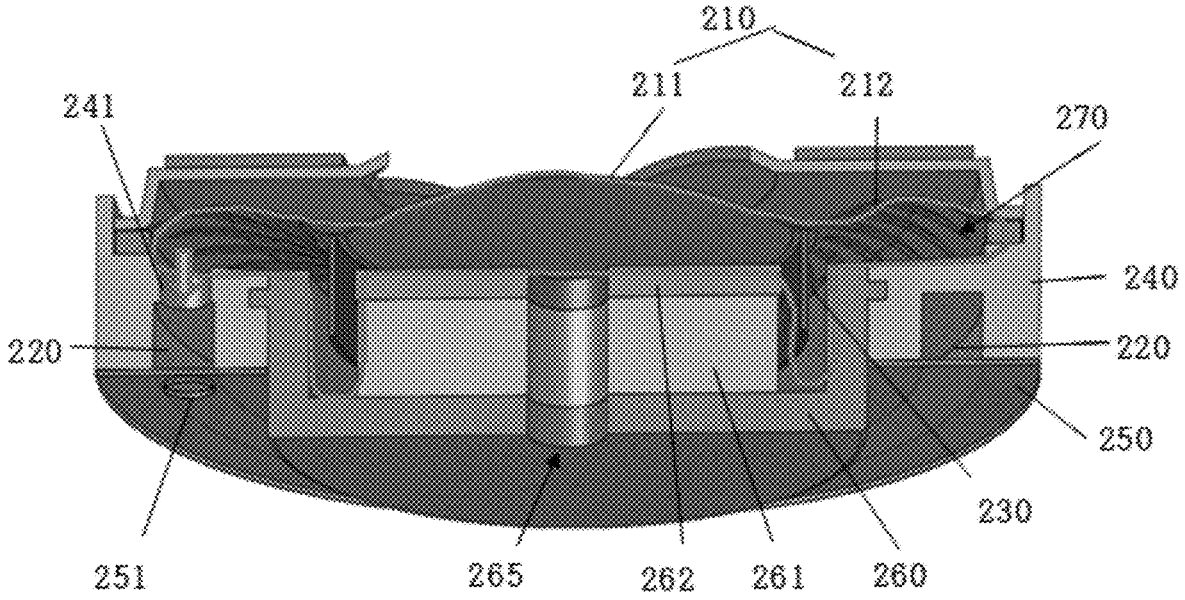
FIG. 5 is a view showing the structure of a microspeaker according to a second embodiment of the present invention.
Figure 6:
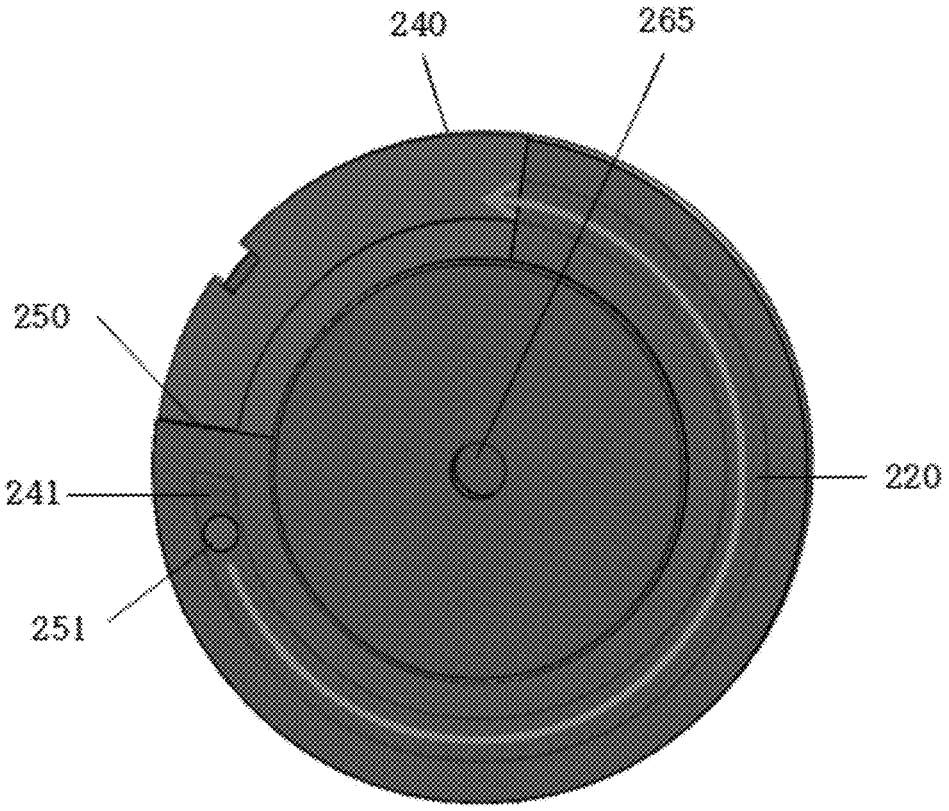
FIG. 6 is a bottom view showing the structure of the microspeaker according to the second embodiment of the present invention.
Figure 7:
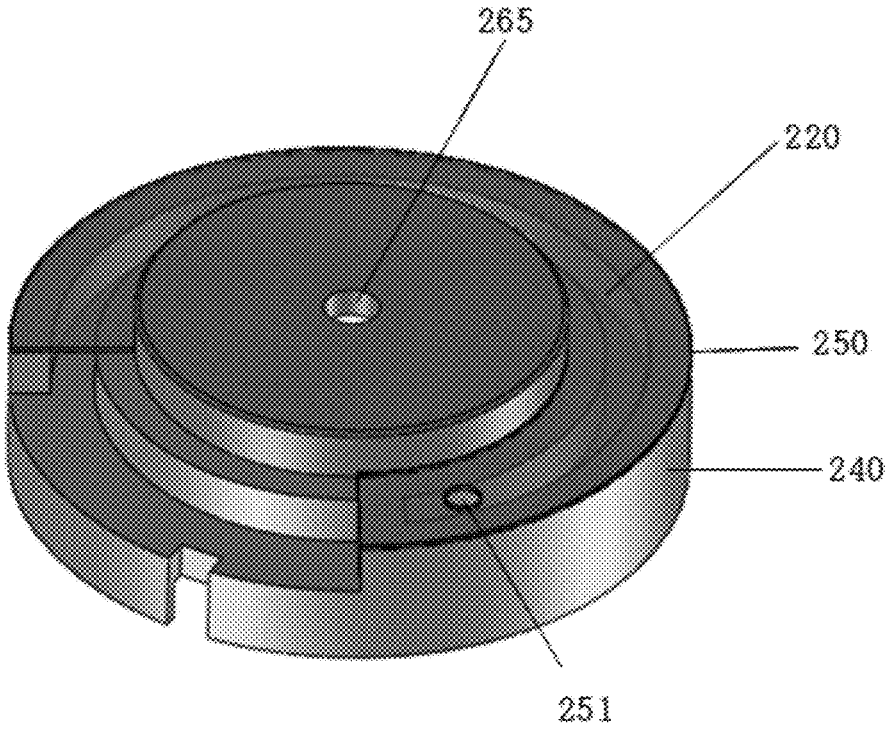
FIG. 7 is a bottom perspective view showing the structure of the microspeaker according to the second embodiment of the present invention.

FIG. 5 is a view showing the structure of the microspeaker according to the second embodiment of the present invention, FIG. 6 is a bottom view showing the structure of the microspeaker according to the second embodiment of the present invention, and FIG. 7 is a bottom perspective view showing the structure of the microspeaker according to the second embodiment of the present invention.

As shown in FIGS. 5 to 7, according to the second embodiment of the present invention, there is provided the structure of a microspeaker, including: a frame 240 configured to have an internal space, a magnetic field part disposed inside the frame 240 and configured to form an air gap along with the frame 240, and a diaphragm 210 configured to vibrate vertically in response to the operation of a voice coil 230 located inside the air gap, wherein a duct 220 configured to guide an air flow is formed along the circumferential direction of the frame 240; wherein the voice coil 230 is located in the air gap between the frame 240 and the magnetic field part.

The structure of the microspeaker according to the second embodiment of the present invention is different from the structure of the microspeaker according to the first embodiment of the present invention in that in the structure of the microspeaker according to the first embodiment of the present invention, the duct sound outlet 252 is formed in the part of the duct plate 250 near the other end of the duct 220 while in the structure of the microspeaker according to the second embodiment of the present invention, a separate duct sound outlet 252 is not formed in the duct plate 250 and the other end of the duct 220 is open and functions as a sound outlet.

As shown in the drawings, air enters the duct 220 from the internal chamber 270 under the diaphragm 210 through a frame hole 241, the air flow of the air is guided through the duct 220 in the arrow direction shown in FIG. 6, and then the air is discharged through the other open end of the duct 220. Other configurations and effects are the same as those of the first embodiment, and thus detailed descriptions thereof will be omitted.

Figure 8:
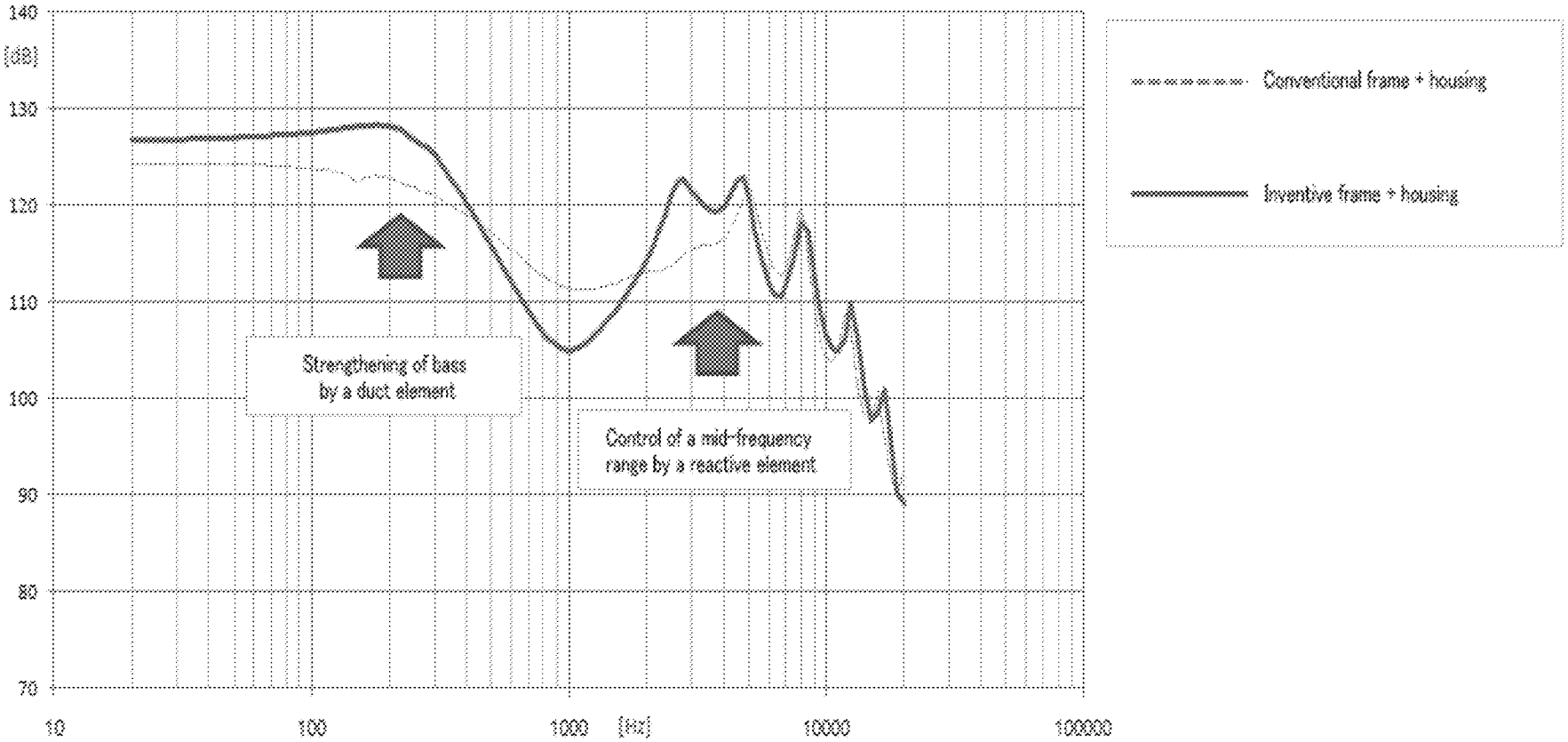
FIG. 8 is a view showing the comparison between the characteristics of a microspeaker having a conventional frame and the characteristics of a microspeaker having a frame according to the present invention.

Meanwhile, FIG. 8 shows the comparison between the characteristics of a microspeaker in which only a first or second reactive control part is present in a speaker frame 240 and a duct is not present in a housing and the characteristics of the microspeaker according to the present invention in which the reactive control parts according to the present invention are included and the duct is formed in the frame. As shown in FIG. 8 (the units of measurement on the x axis: Hz; and the units of measurement on the y axis: dB), it can be seen that in the microspeaker according to the present invention, bass was strengthened by the duct and mid-frequency control was performed by the reactive control parts.

Figure 9:
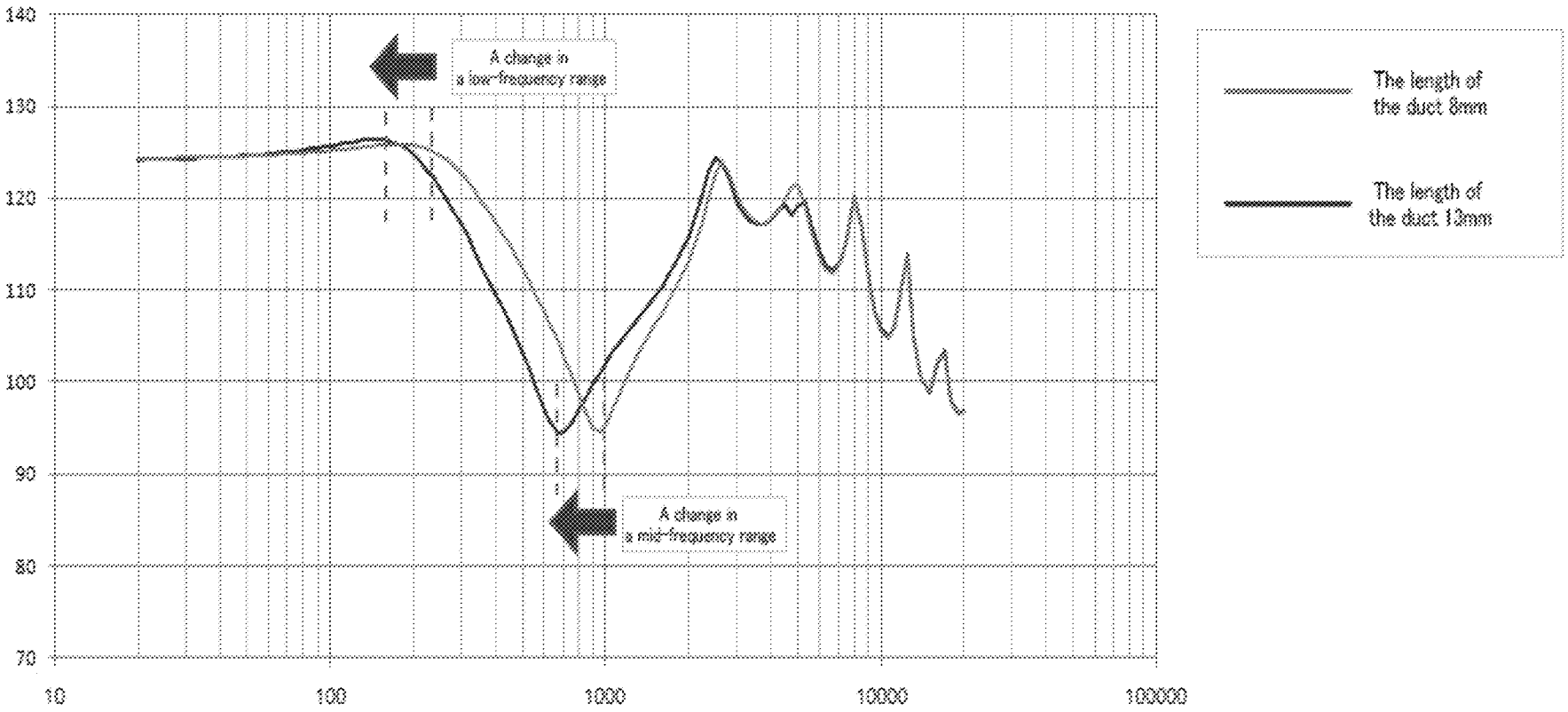
FIG. 9 is a view showing characteristics according to the lengths of ducts.

FIG. 9 (the units of measurement on the x axis: Hz; and the units of measurement on the y axis: dB) is a view showing characteristics according to the lengths of ducts. FIG. 9 shows the comparison between a case where the length of a duct was 8 mm and a case where the length of a duct was 13 mm. For this drawing, it can be seen that the case where the length of the duct is 13 mm exhibited changes in low- and mid-frequency ranges compared to the case where the length of the duct is 8 mm, as shown in the graph.

Figure 10:
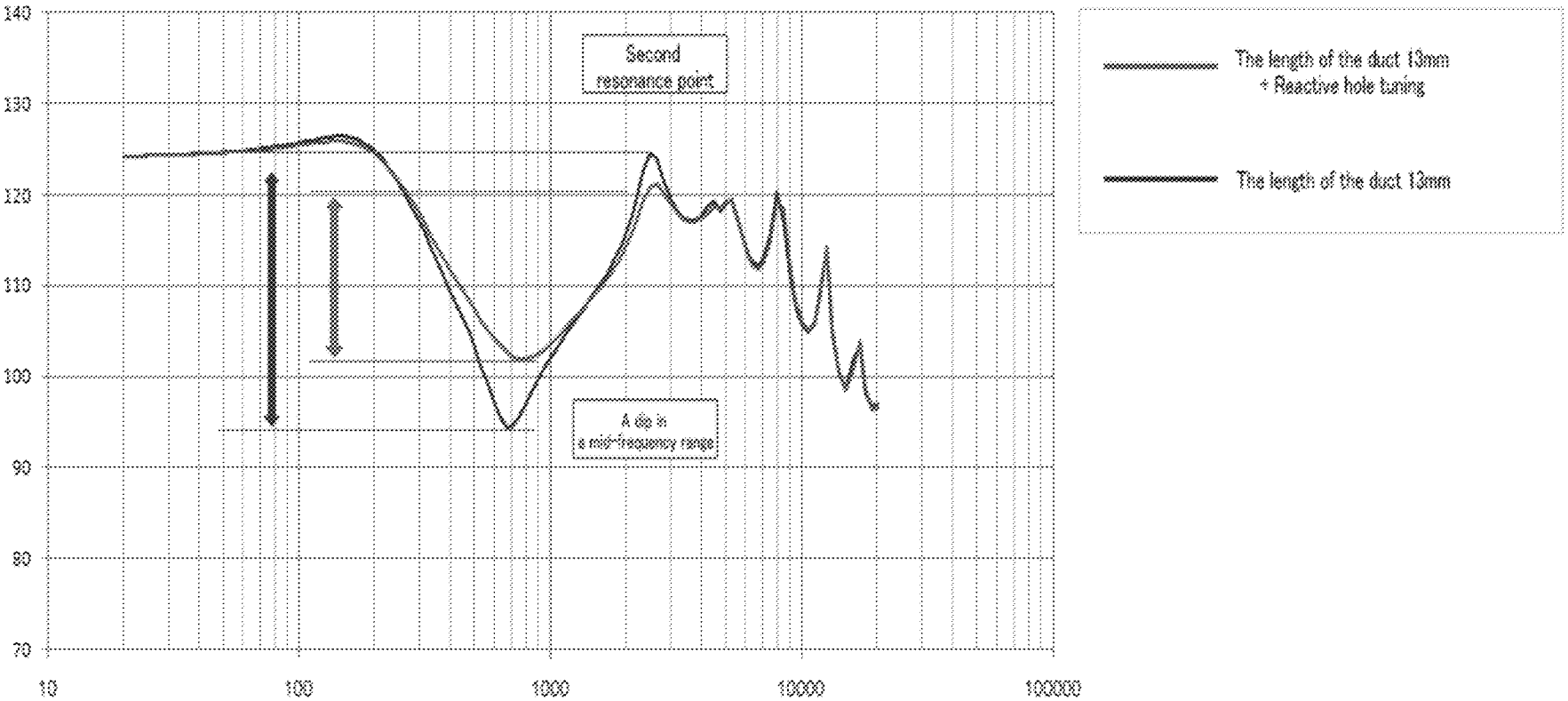
FIG. 10 is a view showing the validity of a reactive control part.

Furthermore, FIG. 10 (the units of measurement on the x axis: Hz; and the units of measurement on the y axis: dB) is a view showing experiments on the validity of the reactive control part. In the case where there is no reactive element, the difference in height between a second resonance point and a dip in a mid-frequency range is large, thus resulting in unnatural sounds. However, in this case, the mid-frequency range can be controlled by a reactive element as desired by a designer, and thus more flat sound may be implemented.

Accordingly, although a duct effect may be achieved without a reactive control hole, the reactive control element is used to compensate for a dip in a mid-frequency range and to perform tone tuning.

Furthermore, in the present invention, tuning may be performed based on the length of the duct as desired by a user. An earphone unit fabricated in the range of 4 to 16 mm may include a duct in the range of one millimeter to tens of millimeters. A head phone speaker may accommodate a duct in the range up to hundreds of millimeters.

Figure 11:
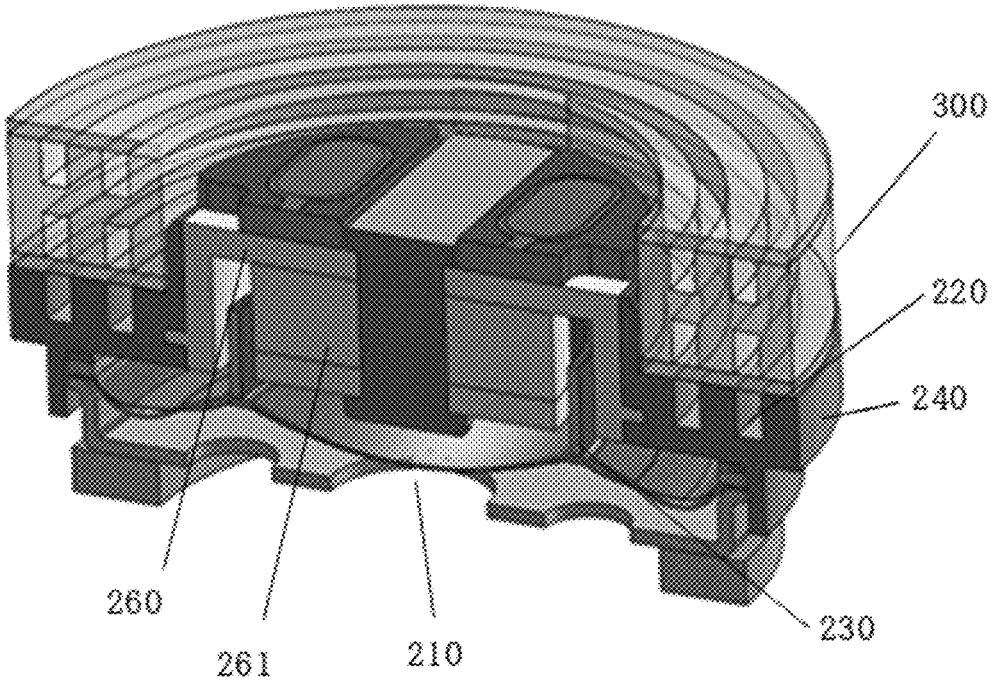
FIG. 11 is a view showing the structure of a microspeaker according to another embodiment of the present invention.

Furthermore, although the duct 200 may be formed in a single row, the duct 220 may include ducts that are formed in two or more rows, as shown in FIG. 11. As shown in this drawing, the length of the ducts may be increased by mounting a separate structure 300 under a frame 240.

As a result, according to the present invention, there is provided the structure of the microspeaker, in which production efficiency may be improved through a reduction in deviation and bass performance may be also improved by disposing the duct and the reactive element in the speaker driver and sound quality may be improved by controlling mid-frequency characteristics.

While the present invention has been described in conjunction with the preferred embodiments, the present invention is not limited to the embodiments. It will be apparent those having ordinary knowledge in the art to which the present invention pertains that various modifications and alterations may be made without departing from the spirit of the present invention.

What is claimed is:

1. A structure of a microspeaker, comprising:

a frame (240) configured to have an internal space, a magnetic field part disposed inside the frame (240) and configured to form an air gap along with the frame (240), and a diaphragm (210) configured to vibrate vertically in response to operation of a voice coil (230) located inside the air gap, wherein a duct (220) configured to guide an air flow is formed in a bottom face of the frame (240) in a circumferential direction of the frame (240) in a groove shape, and a bottom of the duct (220) is formed by coupling a duct plate (250), corresponding to a guide path of the duct (220), to the bottom of the frame (240);

wherein at least one frame hole (241) is formed such that air enters the duct (220) from an internal chamber (270) of the frame (240), at least one duct sound outlet is formed such that air having entered the duct (220) is discharged to an outside through the guide path of the duct (220), and a first reactive control part (251) including at least one hole is formed in the duct plate (250), the first reactive control part (251) being disposed at one end portion of the duct (220) where the at least one frame hole (241) is formed.

2. The structure of claim 1, wherein the duct plate (250) is made of adhesive tape, material in which a damping member is combined with adhesive tape, or material capable of maintaining a plane.

3. The structure of claim 1, wherein the duct sound outlet is formed in such a manner that a remaining end of the duct (220) is open.

4. The structure of claim 1, wherein the duct (220) comprises one or more ducts that are formed in one or more rows in the circumferential direction of the frame (240).

5. The structure of claim 1, wherein the duct (220) has a length in a range of 2 to 200 mm.

6. The structure of claim 1, wherein the duct sound outlet or duct (220) has a sectional area in a range of 0.1 to 100 $mm^2$.

* * * * *